US005691730A

United States Patent [19]

Egashira et al.

[11] Patent Number: 5,691,730

[45] Date of Patent: Nov. 25, 1997

[54] RETRACTABLE BROAD-BAND ANTENNA FOR PORTABLE TELEPHONES

[75] Inventors: Yoshimi Egashira, Sagamihara; Minoru Taguchi, Shiroi-machi, both of Japan

[73] Assignee: Harada Kogyo Kabushiki Kaisha, Tokyo, Japan

[21] Appl. No.: 708,789

[22] Filed: Sep. 9, 1996

Related U.S. Application Data

[63] Continuation of Ser. No. 326,585, Oct. 20, 1994, abandoned.

[51] Int. Cl.[6] ..... H01Q 1/24; H01Q 1/36

[52] U.S. Cl. ..... 343/702; 343/895; 343/901

[58] Field of Search ..... 343/702, 895, 343/900, 901, 722, 723, 751; H01Q 1/24, 1/36

[56] References Cited

U.S. PATENT DOCUMENTS 5,134,419 7/1992 Egashira ..... 343/722
5,469,177 11/1995 Rush et al. ..... 343/702

FOREIGN PATENT DOCUMENTS

94/17565 8/1994 WIPO ..... H01Q 1/24
94/21001 9/1994 WIPO ..... H01Q 1/24

*Primary Examiner*—Hoanganh T. Le
*Attorney, Agent, or Firm*—Koda & Androlia

[57] ABSTRACT

A retractable broad-band antenna for a portable telephone which includes a first antenna element which resonates in the lower region of the frequency band, a second antenna element which is coupled in series to the first antenna element via electrostatic capacitance and resonates in the higher region, and a call-receiving third antenna element mounted to the tip end of the second antenna element. The first and second antenna elements are shortened antenna elements in a form of helical coils. The first antenna element has an electrical length of λL/8 and is a non-grounded type having broad band characteristics by means of a matching device; and the second element has an electrical length of λH/2 wherein λH and λL are respectively the wave lengths at a center frequency of the higher and lower region of the frequency band used. The third antenna element preferably has a conductive contact so that the tip portion of the second antenna element, which stays outside of the telephone housing when the base portion of the second antenna element is retracted into the housing, can act as a call-receiving antenna element.

5 Claims, 8 Drawing Sheets

①: FIRST ANTENNA ELEMENT ALONE

②: FIRST & SECOND ANTENNAS (WITH CASING)

RETRACTABLE BROAD-BAND ANTENNA FOR PORTABLE TELEPHONES

This is a continuation of application Ser. No. 08/326,585, filed Oct. 20, 1994 now abandoned.

BACKGROUND OF THE INVENTION

1. Field of the Invention

The present invention relates to a retractable broad-band antenna for the so-called hand-held type portable telephone which is attached to such a portable telephone and is capable of ultra-shortwave transmission and reception for the purpose of receiving call signals and communicating with correspondents.

2. Prior Art

One type of conventional antenna of this type includes an external antenna, which is a whip antenna and is attached to the portable telephone housing in a manner that the antenna can be freely attached and removed, and a call-receiving internal antenna, which is used to respond to call signals and installed inside the housing. This system is designed so that switching between the external antenna and the internal antenna is accomplished by insertion and removal of the external antenna.

The antenna described above is constructed so that the call-receiving internal antenna is installed inside the portable telephone housing. Accordingly, the housing needs to have a relatively large internal space. Such an increase in the size of the housing runs counter to the reduction in size and weight which are strongly desired as an essential feature of portable telephones and should therefore be avoided as much as possible.

Accordingly, a retractable antenna for a portable telephone which uses a single antenna element having a prescribed electrical length has been proposed. In this proposed antenna, though the structure is simple, the problems such as below have been encountered. In particular, the size of an antenna is in general directly proportional to the magnitude of the gain and the width of the band of the antenna and inversely proportional to the value of the frequency used. Accordingly, if the size of the antenna is set so as to be suited to the prescribed ultra-shortwave frequencies used in portable telephones, the antenna as a whole can be small in size, but the band is correspondingly narrowed and the gain drops.

The frequency band used in recent mobile wireless telephone systems tends to become increasingly broader. For example, in the JDC (Japan Digital Car-phone) system, a band width equal to approximately 20% of the frequency is considered necessary in the 900 MHz band.

A band width broadening means that uses a double tuning system is disclosed, for example, in the Japanese Patent Application No. 02-170996 (which has the Japanese Patent Application Laid-Open No. 04-058603). This is known as one means of achieving a broad band width. Though this system may increase the band width to some extent, an examination of the gain obtained by this system indicates that there is a conspicuous drop in gain near both ends of the band. However the transmission and reception channels are ordinarily located near the ends of the band. Accordingly, such a drop in gain at both ends of the band urgently requires amelioration.

As described above, in the conventional antennas in which a call-receiving antenna is provided inside the housing, the housing requires a large internal volume.

Accordingly, there is a danger that the housing size conflicts to a desired size and weight reduction of the portable telephone. Furthermore, since call-receiving antennas which are accommodated inside the telephone housing generally have a poor sensitivity, there is a danger that call signals will not be received reliably. Moreover, the structure of such a system is relatively complex, and it is difficult to manufacture such antennas at a lower cost.

Meanwhile, in the conventional antennas that include a single antenna element with a prescribed electrical length, the structure of the antenna is simple. However, if the antenna element is set at a size that is suitable to the ultra-shortwave frequencies used in portable telephones, good VSWR characteristics is not obtained for the entire frequency band used. If a band width broadening means such as a double tuning system, etc., is employed, an increased band width is obtained in terms of the impedance characteristics. However, from the standpoint of practical use, the drop in gain near both ends of the band, where the transmission and reception channels are located, is large, and high-sensitivity transmission and reception become impossible.

SUMMARY OF THE INVENTION

The object of the present invention is to provide a retractable broad-band antenna for a portable telephone which has a simple structure and is easy to manufacture, involves no danger of any interference with a desired size and weight reduction of the portable telephone, has good VSWR characteristics for a broad band width equal to approximately 20% of the frequency used even in cases where the size of the antenna element is set at a size suited to the ultra-shortwave frequencies used in portable telephones, and provides a large gain near both ends of the band where the transmission and reception channels are located so that high-sensitivity transmission and reception is accomplished, thus providing a reliable call-receiving function.

In order to solve the problems and achieve the object, the following means is employed in the present invention:

(1) It includes a linear first antenna element which resonates in the lower region of the frequency band used, a linear second antenna element which is coupled in series to the tip of the first antenna element via a high-frequency coupling means so as to resonate in the higher region of the frequency band used, and a third antenna element that receives incoming call signals and is formed using a portion of the tip-side portion of the second antenna element.

(2) The first and second antenna elements are of the shortened antenna elements which consist mainly of helical coils.

(3) The first antenna element is a non-grounded type which has an electrical length of $3\lambda L/8$, where $\lambda L$ is the wavelength at the center frequency on the lower-region side of the frequency band used and is endowed with broad-band characteristics by means of a matching device.

(4) The second antenna element has an electrical length of $\lambda H/2$, where $\lambda H$ is the wavelength at the center frequency on the higher-region side of the frequency band used.

(5) The third antenna element has a conductive contact located in the base of the tip-side portion of the second antenna element, so that the tip-side portion of the second antenna element which is not inside the housing can act as a call-receiving antenna element when the base-side portion of the second antenna element is accommodated inside the portable telephone housing.

As a result of the means taken as described above, the following functions are obtained:

(a) The antenna is constructed mainly from antenna elements which form a single linear part that can be freely inserted into and removed from the housing. Accordingly, the structure of the antenna is simple, and manufacture of the antenna is easy. Furthermore, since there is no need to greatly increase the internal volume of the housing, there is no danger that the size of the housing would conflict the reduction in the size and weight of the portable telephone.

(b) During the use of the portable telephone, the first antenna element, which protrudes to the outside of the housing, and the second antenna element, which is coupled to the tip of the first antenna element via a high-frequency coupling means such as an electrostatic capacitance or electromagnetic induction, etc., can act together. As a result, the VSWR characteristics of the first antenna element and the VSWR characteristics of the second antenna element are combined, resulting in that good VSWR characteristics are obtained for an extremely broad frequency band.

(c) In addition, the gain near both ends of the band, where the transmission channel and reception channel are located, is greatly improved. Thus, high-sensitivity transmission and reception can be achieved.

(d) When the first antenna element and second antenna element are inserted into the interior of the housing, the first antenna element is completely inside the housing but the tip-side portion of the second antenna element is not in the housing and stays outside. In this case, a contact installed on an intermediate portion of the second antenna element contacts, for example, a conductive element which is installed on an intermediate portion of the second antenna element so that the base part of the tip-side portion is connected to the output terminal of the matching device. Accordingly, the tip-side portion of the second antenna element which protrudes to the outside of the housing, that is, the third antenna element, acts as a call-receiving antenna element, and thus a reliable reception of call signals is secured.

DETAILED DESCRIPTION OF THE INVENTION

Figure 1A:
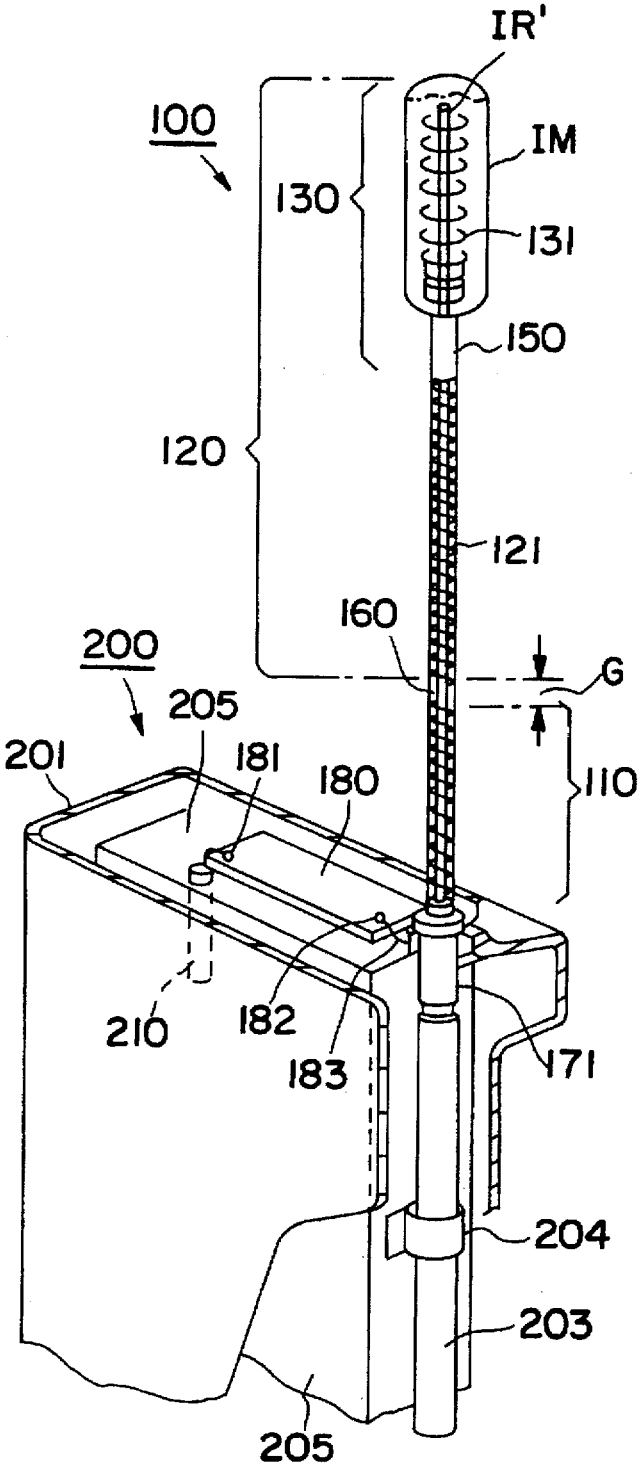
FIG. 1 is a partially cut-away perspective view showing a detachable antenna for a portable telephone of one embodiment according to the present invention with the antenna extended from the housing, wherein FIG. 1(*a*) shows the overall structure, and FIG. 1(*b*) shows a magnification of essential parts.
Figure 1B:
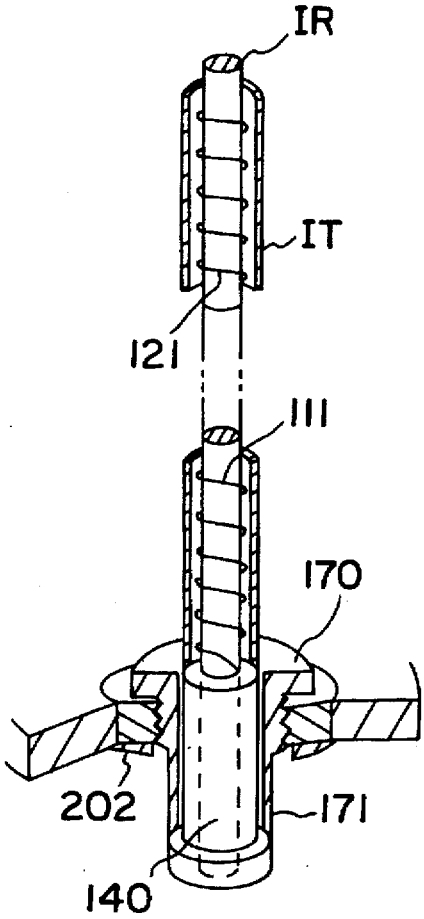

FIGS. 1(*a*) and (*b*) are partially cut-away perspective views which illustrate a retractable antenna for a portable telephone according to one embodiment of the present invention with the antenna extended from the portable telephone housing.

FIG. 1(*a*) shows the overall structure of the antenna, and FIG. 1(*b*) shows in an enlarged manner the essential parts in FIG. 1(*a*).

Figure 2:
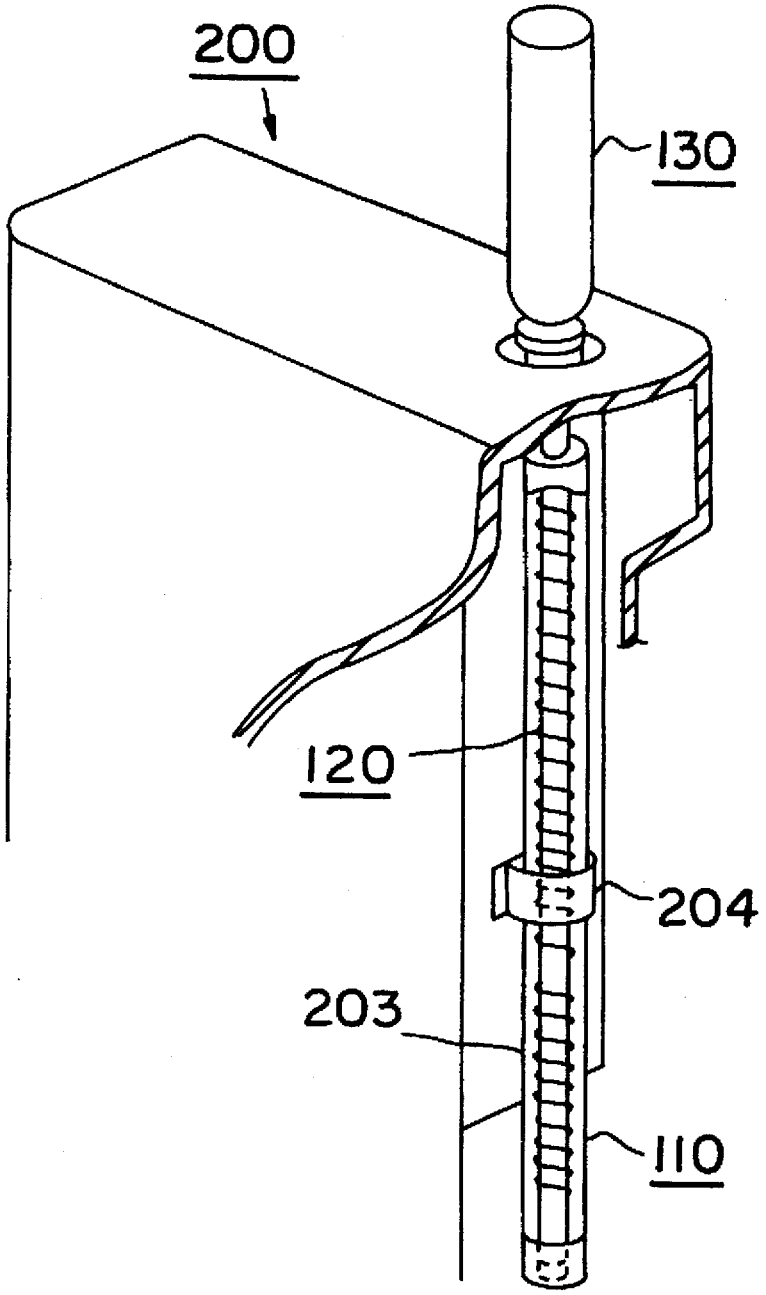
FIG. 2 is a partially cut-away perspective view showing the detachable antenna for a portable telephone of the above embodiment accommodated inside the housing.

FIG. 2 is a partially cut-away perspective view which shows the retractable antenna for a portable telephone of the same embodiment with the antenna accommodated inside the portable telephone housing.

In FIGS. 1 and 2, 100 indicates a detachable antenna for a portable telephone, and 200 indicates a portable telephone housing.

The retractable antenna 100 for a portable telephone includes: a linear first antenna element 110 which resonates in the lower region of the frequency band used; a linear second antenna element 120 which is coupled to the tip end of the first antenna element 110 so as to resonate in the higher region of the frequency band used; and a call-receiving third antenna element 130 which is a part of the tip-side portion of the second antenna element 120.

The first antenna element 110 and a portion of the second antenna element 120 that extends downward from an intermediate point of the second antenna element 120 are shortened antenna elements which are formed by winding a first helical coil 111 and a second helical coil 121 around a single flexible insulating rod IR with these helical coils being separated by a gap G. The outer circumferences of the coils are covered with an insulating tube IT. The third antenna element 130 is also a shortened antenna element which is formed by winding a helical coil 131 around an insulating rod IR' and by covering the outer circumference of the coil with an insulating member IM that is a soft resin, rubber, etc.

A flange-equipped conductive cylinder 140, which also acts as a stopper for preventing the antenna elements from slipping out, is attached to the base-side portion of the first antenna element 110. Furthermore, a contact 150 which is of a conductor is installed on the base portion of the third antenna element 130.

The base end of the first helical coil 111 is connected to the flange-equipped conductive cylinder 140, and the tip end of the first helical coil 111 is free. The base end of the second helical coil 121, which faces the free tip end of the first helical coil 111 across the gap G, is also free; and the tip end of the second helical coil 121 is connected to the contact 150. The base end of the helical coil 131 of the third antenna element 130 is connected to the contact 150, and the tip end of the helical coil 131 is free.

Thus, the first antenna element 110 and second antenna element 120 are coupled in series via an electrostatic capacitance 160 that is obtained by the gap G, which acts as a high-frequency coupling means. The third antenna element 130 includes the contact 150 installed on the base of the tip-side portion of the second antenna element 120 so as to function as a feeding element. Thus, when the base-side portion of the second antenna element 120 is accommodated inside the housing 200, the tip-side portion of the second antenna element 120, which is not inside the housing 200, can act as a call-receiving antenna element.

In order to obtain broad band characteristics and a non-grounded state, the first antenna element 110 has an electrical length of 3λL/8, where λL is the wavelength at the center frequency of the lower region of the frequency band used. Furthermore, as will be described below, a non-grounded antenna element endowed with even better broad band characteristics is realized by using a matching device 180 in combination with the structure. Furthermore, the second antenna element 120, which is electrostatically coupled to the first antenna element 110, has an electrical length of λH/2, where λH is the wavelength at the center frequency of the higher region of the frequency band used. Moreover, the third antenna element 130 is designed so that the length from the free upper end of the helical coil 131 to the contact 150 is set so as to be equal to an electrical length of approximately λH/4 to 3λH/8.

The first antenna element 110 and the base-side portion of the second antenna element 120 are designed so as to be in the housing 200. More specifically, an annular conductive member 202 is embedded in the antenna insertion and removal port formed in the upper wall of the case 201 of the housing 200. The outer circumferential part of a conductive slide-retaining tube 170 which holds the antenna elements so that they can slide is screw-engaged to the annular conductive member 202.

The tip-end portion, which is the lower end portion as shown in the Figures, of the slide-retaining tube 170 has a spring portion 171 whose top end is offset in the axial direction. Thus, the slide-retaining tube 170 acts so that the flange-equipped conductive cylinder 140 which can act also as an anti-slipping stopper, the insulating tube IT and the contact 150 are free to slide, and so that the antenna elements can be stably held in the inserted and withdrawn positions. More specifically, when the first antenna element 110 and the second antenna element 120 are extended to the outside of the housing 200, the slide-retaining tube 170 makes a conductive contact with the flange-equipped conductive cylinder 140; and the antenna elements are stably held extended as shown in FIG. 1(*b*). Furthermore, when the first antenna element 110 and the second antenna element 120 are pushed into the housing 200, the slide-retaining tube 170 makes a contact with the contact 150; and the antenna elements are stably held inside.

An insulating tube 203 which is used to accommodate the antenna elements is installed beneath, with respect to the drawings, where the annular conductive member 202 of the case 201 is located. The insulating tube 203 is fastened to the side surface of a shielding case 205 (described later) by means of a fastener 204 used for attachment. The fastener 204 used for attachment is grounded to the shielding case 205. The attachment position of the fastener 204 is set so as to be separated from the annular conductive member 202 by a prescribed electrical length so that the impedance near the annular conductive member 202 is extremely large, ideally to infinity.

Thus, after the antenna elements have been accommodated, the impedance characteristics seen from the input terminal of the impedance matching device 180 (described later) are suited to the helical coil 131 that has an electrical length of λH/4 to 3λH/8, so that the coil 131 can function as the call-receiving third antenna element 130.

In the housing 200, the electrical circuitry of the portable telephone covered by the shielding case 205 is accommodated inside the case 201. An impedance matching device 180 formed by, for example, a printed circuit board is carried on and fastened to the top of the shielding case 205. The input terminal 181 of this impedance matching device 180 is connected to a coaxial line 210 which is connected to a transmitting and receiving circuit in the telephone circuitry. Furthermore, the output terminal 182 of the matching device 180 is connected via a conductor 183 to the annular conductive member 202 embedded in the case 201.

Thus, the impedance matching device 180 is connected to the conductive cylinder 140 which is the feeding point of the first antenna element 110 or to the contact 150 which is the feeding point of the third antenna element 130. Accordingly, the impedance matching device 180 can act to adjust the impedance characteristics as viewed from the input terminal of the matching device so that the characteristics of the first antenna element 110 are optimal in the lower region of the frequency band used, and so that the characteristics of the second antenna element 120, when the second antenna element 120 is electrostatically coupled, are optimal in the higher region of the frequency band used. Thus, the impedance matching device 180 makes the overall impedance characteristics to be super-broad-band characteristics.

Next, the operation of the antenna of the present invention constructed as described above will be described with reference to FIG. 3 and subsequent figures.

(a) Since the antenna is designed so as to consist mainly of a single linear antenna element 100 which is installed so that it can be freely retracted into and extended from the housing 200, the antenna is simple in structure and is easy to manufacture. Furthermore, since there is no call-receiving antenna element inside the housing, there is no danger that the internal volume of the housing 200 is especially increased. Accordingly, it is unlikely that the antenna will interfere with the reduction in the size and weight of the portable telephone.

Figure 3A:
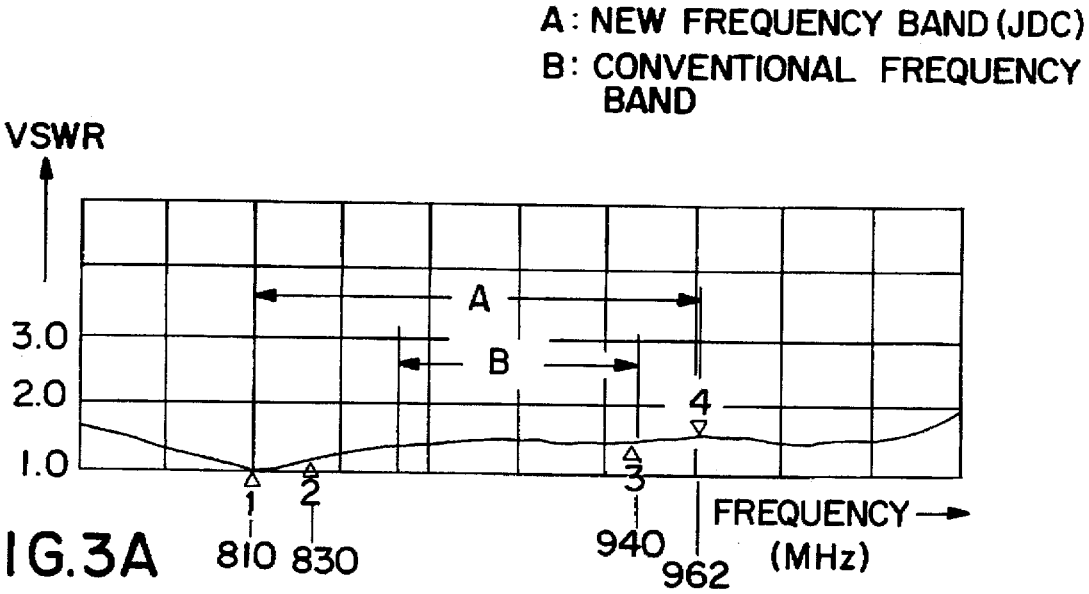
FIG. 3 is a diagram showing the characteristics of the first antenna element in the detachable antenna for a portable telephone of the embodiment, wherein FIG. 3(*a*) is a graph of the VSWR characteristic curve, and FIG. 3(*b*) is a Smith chart.
Figure 3B:
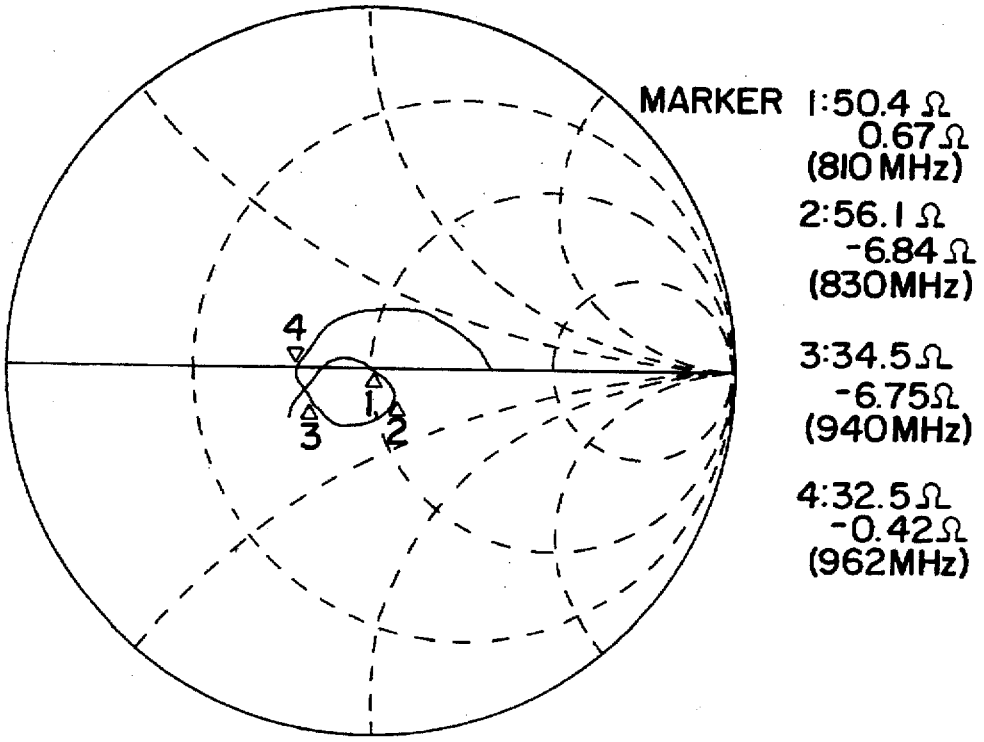
Figure 4A:
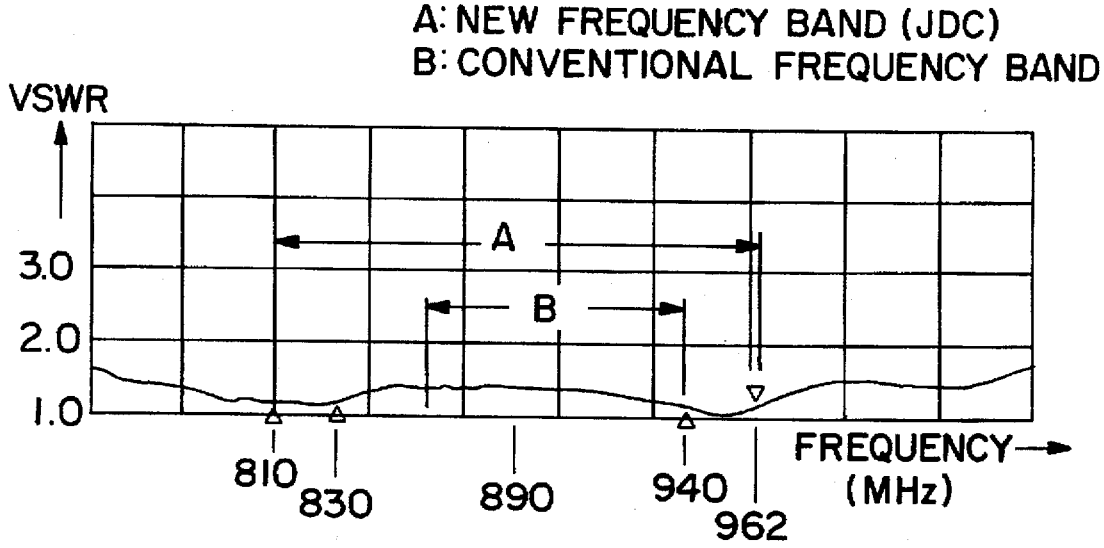
FIG. 4 is a diagram showing the overall characteristics of the first antenna element and second antenna element in the detachable antenna for a portable telephone of the embodiment, wherein FIG. 4(*a*) is a graph of the VSWR characteristic curve, and FIG. 4(*b*) is a Smith chart.
Figure 4B:
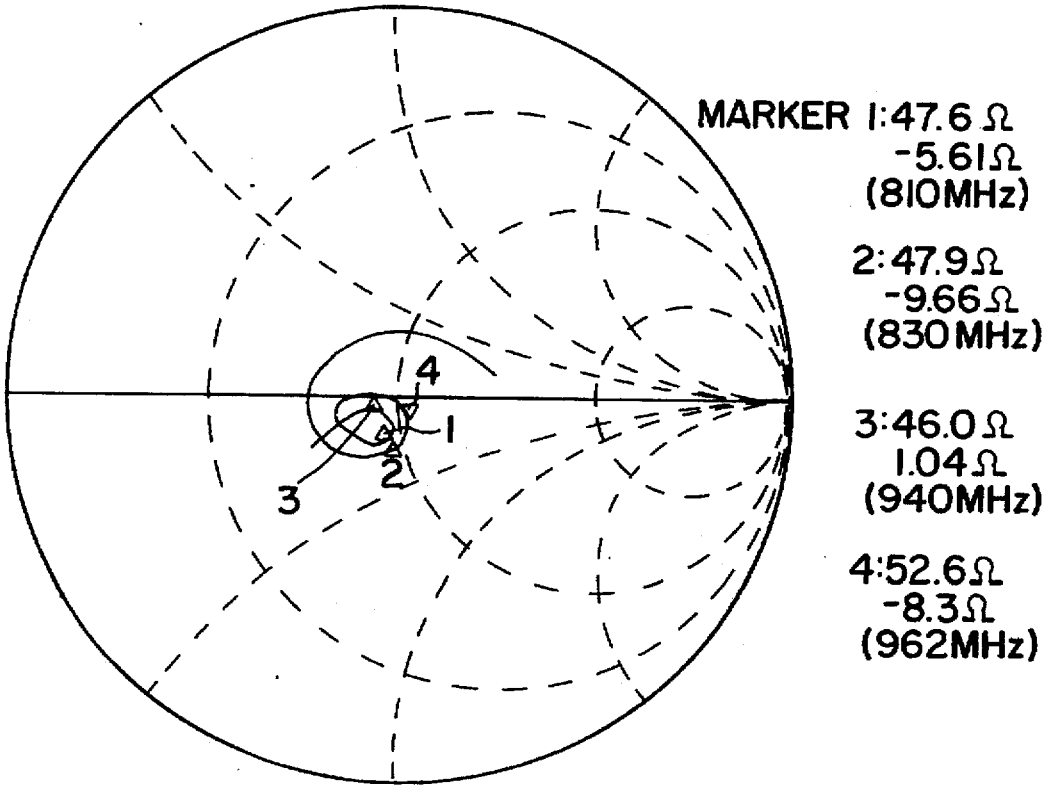

(b) During use, the first antenna element 110, which protrudes to the outside of the housing 200, and the second antenna element 120, which is coupled to the tip end of the first antenna element 110 via a high-frequency coupling means depending on an electrostatic capacitance 160, can act together. More specifically, double tuning characteristics as shown in FIG. 3 are obtained by means of the first antenna element 110 and impedance matching device 180. Furthermore, triple tuning characteristics as shown in FIG. 4 are realized since the second antenna element 120 is electrostatically coupled to the first antenna element 110. Accordingly, the VSWR characteristics of the first antenna element 110 and the VSWR characteristics of the second antenna element 120 are combined, and good VSWR characteristics are obtained for an extremely broad frequency band. In addition, as shown in FIG. 4, the width of the band where the VSWR value is 1.7 or less is 30% or more of the center frequency of 890 MHz, and this value is even broader than the new frequency band A. Furthermore, the VSWR characteristics in the higher region where the transmission channel is located are improved. Accordingly, the overall efficiency is improved, and the consumption of the battery of the portable telephone can be reduced, allowing longer-term use at a given battery capacity.

Figure 5:
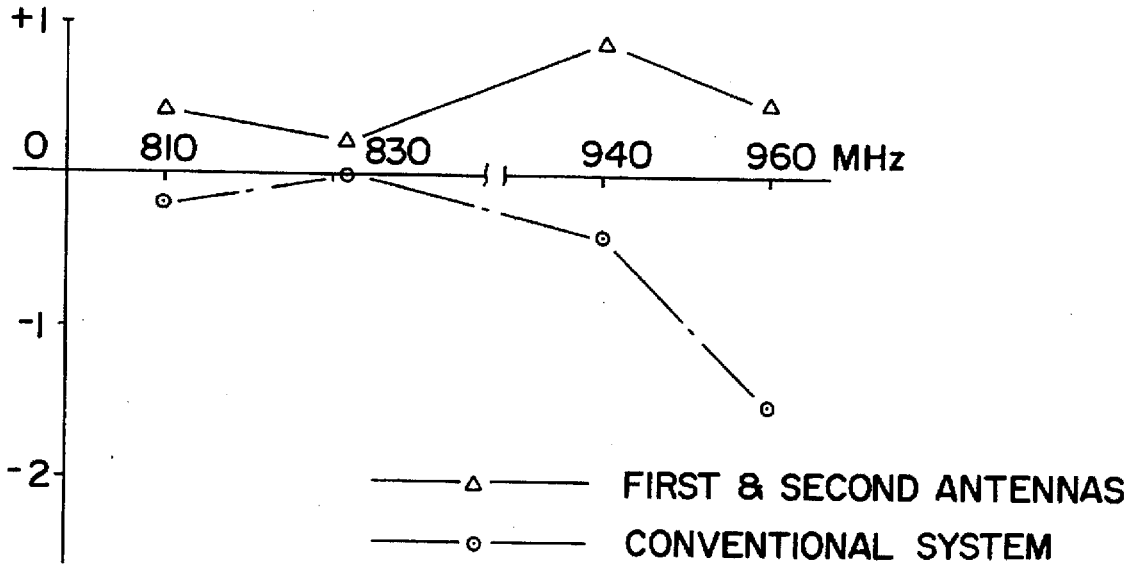
FIG. 5 is a graph comparing the relative gain in the detachable antenna for a portable telephone of the embodiment with that of a conventional antenna.

(c) The gain near both ends of the band where the reception channel and transmission channel are located is greatly improved, and the high-sensitivity transmission and reception are obtainable. More specifically, as shown in FIG. 5, as a result of slight excitation of the second antenna element 120 which is shallowly coupled with the first antenna element 110 in the lower region, mainly a drop in gain in the lower region is prevented. Thus, a dipole ratio of +0.5 to +1.0 dBd, which is equal to or greater than that of a conventional antenna, is obtained in free space. In the higher region, the second antenna element 120, which is deeply coupled with the first antenna element 110 in this region, is excited to a greater extent. Thus, a drop in gain in the higher region is prevented, and a value of +0.5 to +1.0 dBd, which exceeds the value obtained in a conventional antenna by approximately +2 dB, is obtained.

Figure 6:
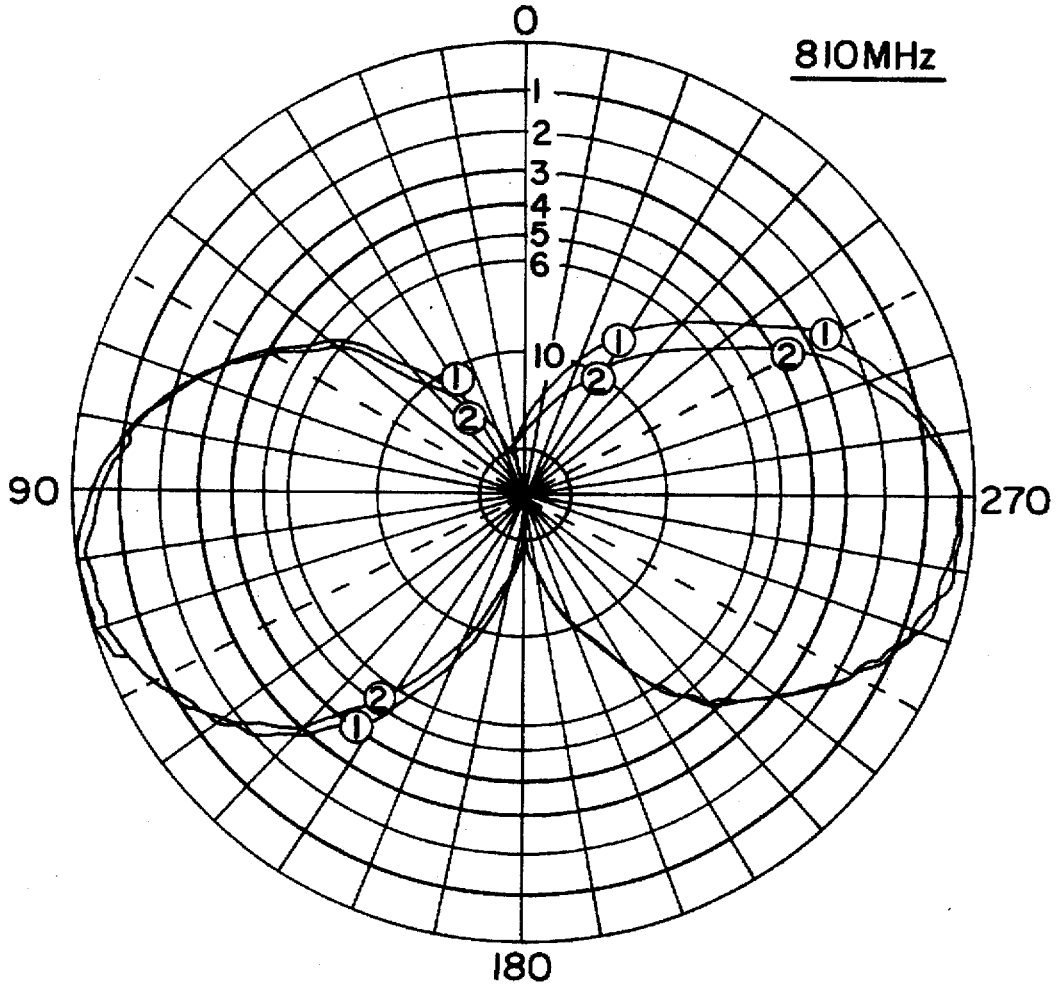
FIG. 6 is a diagram showing an example of actual measurement of the lower-region vertical-plane radiation pattern of the retractable antenna for a portable telephone of the embodiment.
Figure 7:
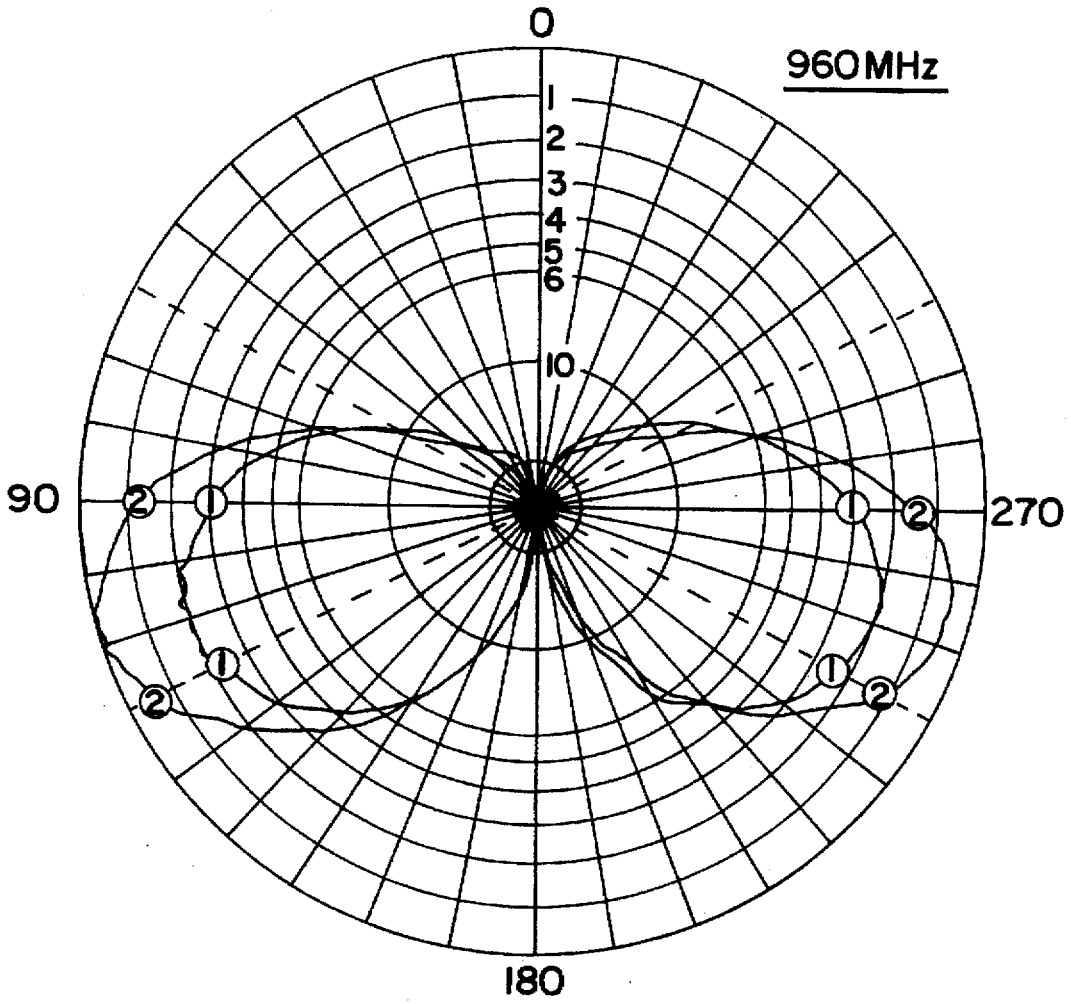
FIG. 7 is a diagram showing an example of actual measurement of the higher-region vertical-plane radiation pattern of the detachable antenna for a portable telephone of the embodiment.

FIG. 6 is a diagram which shows the radiation pattern in the vertical plane in the lower region (810 MHz); and FIG. 7 is a diagram which shows the radiation pattern in the vertical plane in the higher region (960 MHz). As seen from FIGS. 6 and 7, the antenna of the present embodiment has a good directivity in the vertical plane in both the lower and higher regions.

Figure 8:
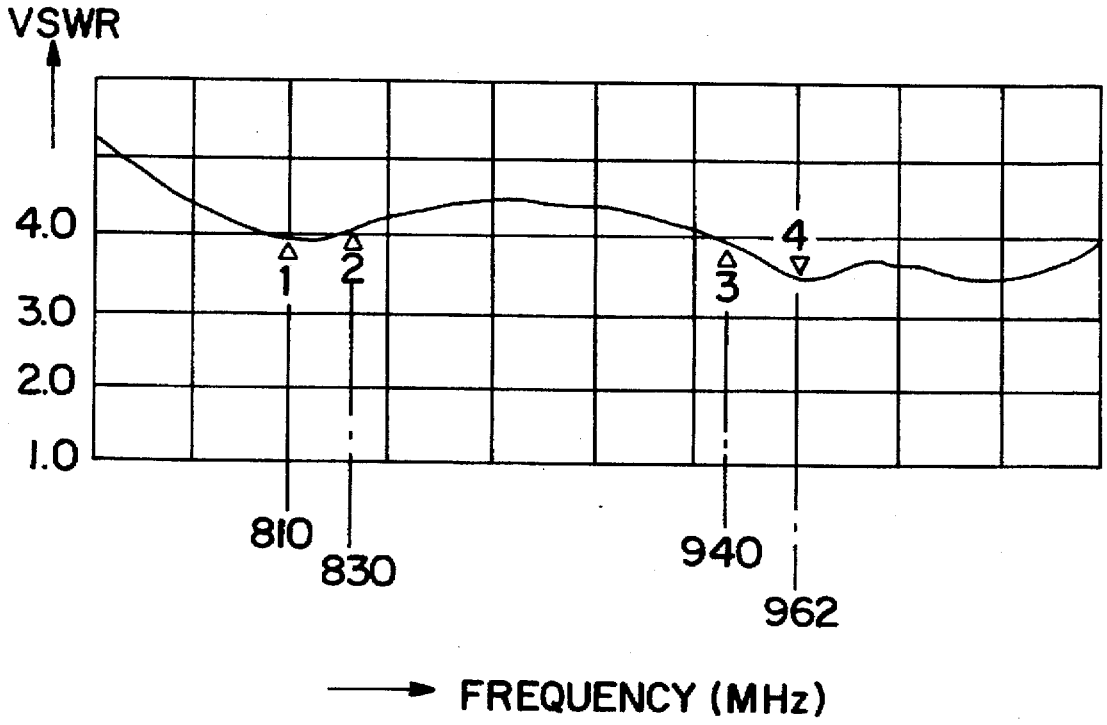
FIG. 8 is a graph of the VSWR characteristics of the third antenna element in the retractable antenna for a portable telephone of the embodiment.

(d) When the first antenna element 110 and the second antenna element 120 are brought inside the housing 200, the first antenna element 110 is completely inside the housing, but the tip-side portion of the second antenna element 120 is not inside the housing 200 and instead stays outside. In this case, the contact 150 provided at an intermediate portion of the second antenna element 120 contacts the annular conductive member 202 which is installed, for example, inside the housing 200. As a result, the base of the tip-side portion is connected to the output terminal 182 of the impedance matching device 180. Accordingly, the tip-side portion of the second antenna element 120 protruding to the outside of the housing, i.e., the third antenna element 130, acts as a call-receiving antenna element. FIG. 8 is a graph that shows the VSWR characteristics of the third antenna element 130. As seen from this figure, call signals can be received reliably.

The present invention is not limited to the embodiment described above, and various modifications are possible within the spirit of the present invention.

As described above, according to the present invention, it is possible to provide a retractable broad-band antenna for a portable telephone, which has a simple structure and is easy to manufacture, which involves no danger of any interference with desired size and weight reduction of a portable telephone, which shows good VSWR characteristics across a broad band equal to approximately 20% of the frequency used even in the cases where the antenna elements are formed so as to have a size suited to the ultra-short wave frequencies for a portable telephone, which shows a sufficient gain near both ends of the band where the transmission and reception channels are located so that high-sensitivity transmission and reception be performed, and which has an accurate call-receiving function.

We claim:

1. A retractable broad-band antenna for a portable telephone characterized in that said antenna comprises:

a linear first antenna element, said linear first antenna element having an electrical length such that a resonant frequency of said linear first antenna element is in a lower region of a frequency band used;

a linear second antenna element which is coupled in series to a tip of the first antenna element via a high-frequency coupling means, said linear second antenna element having an electrical length such that a resonant frequency of said linear second antenna element is in a higher region of the frequency band used; and a third antenna element used for receiving incoming call signals, said third antenna element being provided on a tip-side portion of the second antenna element.

2. A retractable broad-band antenna for a portable telephone according to claim 1 characterized in that the first and second antenna elements are shortened antenna elements which consist mainly of helical coils.

3. A retractable broad-band antenna for a portable telephone according to claim 1 characterized in that the first antenna element is comprised of a non-grounded type antenna element which has an electrical length of $3\lambda L/8$ where $\lambda L$ is a wavelength at a center frequency on the lower-region side of the frequency band used, and an impedance matching device coupled to said first antenna element for adjusting the characteristics of said first antenna element to be optimal at said lower region side.

4. A retractable broad-band antenna for a portable telephone according to claim 1 characterized in that the second antenna element has an electrical length of $\lambda H/2$ where $\lambda H$ is a wavelength at the center frequency on the higher-region side of the frequency band used.

5. A retractable broad-band antenna for a portable telephone according to claim 1 characterized in that a conductive contact for the third antenna element is located on a tip-side portion of the second antenna element so that said third antenna element, which is not inside a housing of a portable telephone when said retractable broad-band antenna is retracted, acts as a call-receiving antenna element when the first and second antenna elements are accommodated inside the housing of the portable telephone.

* * * * *

UNITED STATES PATENT AND TRADEMARK OFFICE

CERTIFICATE OF CORRECTION

PATENT NO. : 5,691,730

DATED : November 25, 1997

INVENTOR(S) : Yoshimi Egashira, et al.

It is certified that error appears in the above-indentified patent and that said Letters Patent is hereby corrected as shown below:

On the title page,
Add Item [30] Foreign Application Priority Data:

--Oct. 21, 1993 [JP] Japan ..... 5-263498--

Signed and Sealed this

Twenty-eighth Day of April, 1998

Bruce Lehman

*Attest:*

BRUCE LEHMAN

*Commissioner of Patents and Trademarks*

*Attesting Officer*